US005813419A

United States Patent [19]

Brams

[11] Patent Number: 5,813,419

[45] Date of Patent: Sep. 29, 1998

[54] HAIR CURLER

[76] Inventor: Patrick Brams, Rue Dieu-le-Garde 3, B-4280 Villers-le-Peuplier, Belgium

[21] Appl. No.: 792,278

[22] Filed: Jan. 31, 1997

[30] Foreign Application Priority Data

Jan. 31, 1996 [BE] Belgium ..... 09600091

[51] Int. Cl.[6] ..... A45D 2/00

[52] U.S. Cl. ..... 132/222; 132/212; 132/248; 132/223

[58] Field of Search ..... 132/222, 203, 132/212, 223, 224, 225, 226, 245, 248, 252, 264, 265, 270, 207; 229/87.01, 87.03, 87.04, 108.1, 103.2

[56] References Cited

U.S. PATENT DOCUMENTS 2,433,141 12/1947 McPherson ..... 132/248
3,530,863 9/1970 Foster ..... 132/222
3,543,771 12/1970 Altman ..... 132/222
3,871,388 3/1975 Leoci ..... 132/223
3,960,156 6/1976 Thompson ..... 132/222

*Primary Examiner*—Gene Mancene
*Assistant Examiner*—Pedro Philogene
*Attorney, Agent, or Firm*—Kolisch Hartwell Dickinson McCormack & Heuser

[57] ABSTRACT

Hair-shaping Device, so-called hair curler, made with a sheet (3), preferably a semi-rigid material, provided with perforations (7), which has been folded a first time lengthwise forming a central fold (9) and then folded in zigzag (13) perpendicularly to said central fold.

18 Claims, 2 Drawing Sheets

Fig. 1
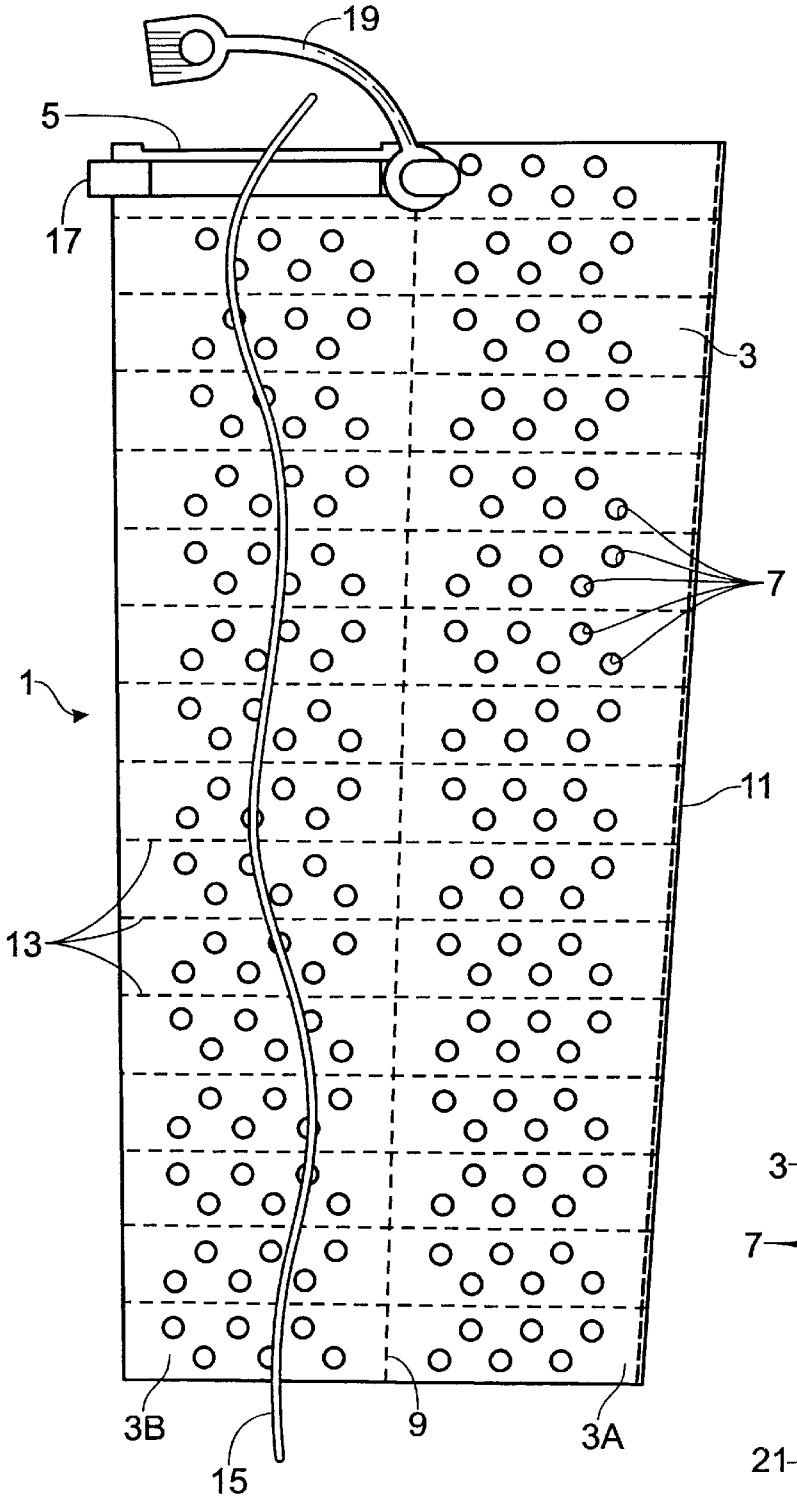
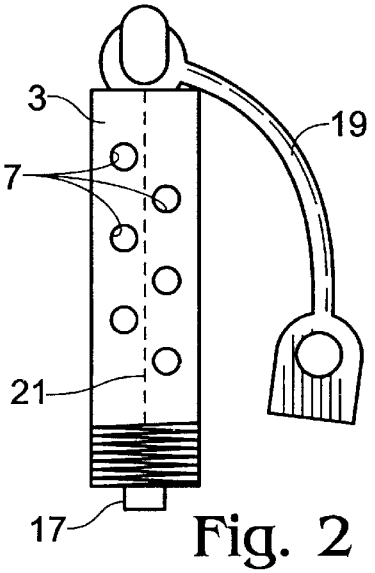
Fig. 2

HAIR CURLER

OBJECT OF THE INVENTION

The present invention relates to a "hair curler", a word used with a broad meaning, that is to say an item for shaping hair.

TECHNOLOGICAL BACKGROUND

Conventionnally hair curlers are made with items such as pins and rolls for giving particular shapes to hair locks, i.e. to curl them.

To do so, hair locks are wound on these hair curlers, for example in a wet condition, and are then dried. In some cases, various "permanent waving" type treatments participate in the hair shaping.

After a certain time, the hair curlers are removed and the hair stay with a curled or waved shape.

Various techniques have been also used to hold the curled shape, for example by using so-called hair-dressing or fixing products.

Practically, however, and essentially depending upon the hair nature, the shapes which may be obtained are limited.

In U.S. Pat. No. 3,871,388 A, a device is described which allows to carry out various hair shapings (curled or straight ones) and is made with a lattice comprising plastics monofilaments and deformable metal wires, arranged parallel to a hinge member enabling to fold said device, closing it.

It is used by interposing hair locks and deforming the assembly in a S-shaped arrangement. Ringlets are so formed, the curling direction of which, unlike what was obtained before with conventional hair curlers, may be first one direction and then the opposed direction.

In U.S. Pat. No. 4,942,892 A, a device is disclosed which allows to carry out Z-like hair shaping, which is made of a long central flat member and two ends which can be folded back onto the central member through two hinges.

The assembly is made of a semi-rigid plastics.

Said device is not provided for shaping in numerous zigzags.

GB 2 194 437 A discloses a deformable shaping member provided with copper wires to allow a folding and the holding in a non flat shape to be carried out.

U.S. Pat. No. 2, 936,766 A describes a resilient strip which is wound to shape curls or ringlets.

FR 649 696 A describes a device made with various hair slides or clips for waving hair.

U.S. Pat. No. 572,027 A discloses a device made with interconnected U-shaped wires, enabling a folding to be carried out.

EP 0 039 072 A discloses a hair curler comprising a spring. It is used conventionally for winding hair and shaping them into curls.

FR 2 416 667 A discloses a device comprising two long flat members of a complementary shape which can be assembled together for waving hair.

FR 1 153 109 A describes a device comprising two parts for pinching hair, Said parts are flexible and allow the device and the hair to be wound spirally or helically.

AIM OF THE PRESENT INVENTION

The present invention aims to provide with a simple technique new shapes through a "hair curler".

It is to be noticed that the term "hair curler" is to be understood in a broad meaning as an item used for hair shaping and that does not imply necessarily that hair are to be wound on the hair curler, as it will appear thereafter.

CHARACTERISTICAL FEATURES OF THE INVENTION

The invention proposes a hair-shaping item, so-called hair curler thereafter, made with a material sheet which may be semi-rigid, rigid or of a paper-like type, provided with perforations, which has been folded a first time in the lengthwise direction thereof, forming a central fold, and which has been then folded in zigzags in a direction substantially perpendicular to said central fold. Advantageously, the starting sheet comprises over at least half a side a cutting corresponding to the width and the heigth of a hair lock which will be interposed between the two overlapped sheet thicknesses and afterwards the so-folded sheet with the two sheet halves being overlapped is folded in a zigzag arrangement.

The above-mentioned folds, including the zigzag folds, can be easily made permanent by a pressure application and by a heat treatment on the folded semi-rigid material.

Advantageously, over at least one of the sheet edges opposed to the central fold, an overthickness can be provided so as to prevent the hair locks to be crushed. Such an overthickness may be provided on both sides, particularly when it is required to introduce convenient products for the desired treatment (permanent waving, hair-fixing or dressing products).

Any convenient means such as clips or an elastic band can be provided so as to hold the hair and the hair curler in the position obtained after a zigzag folding.

The interest of this particular embodiment of such a hair curler is that each of the zigzags forms a curl or a ridge in the hair lock, but the part between said zigzags remains flat and consequently a flat part is formed on the hair locks between each of the ridges.

New special effects, unreachable with the conventional winding hair curlers, can be thus obtained and moreover, as the hair curler used may be designed with different widths, lengths and spacings between the zigzags, it becomes possible to get a plurality of special effects with hair curlers of this type.

DESCRIPTION OF A PREFERRED EMBODIMENT OF THE INVENTION

The invention will be further described referring to a preferred embodiment of the invention on the basis of the enclosed schematic drawings, which are not supposed to be limitative and show a "hair curler" according to the invention.

In the enclosed drawings:

FIG. 1 shows a plan view of the "flat" unfolded hair curler,

FIG. 2 shows the unfolded hair curler, and

In the drawings, identical annotations are used for identical or similar parts.

Figure 3:
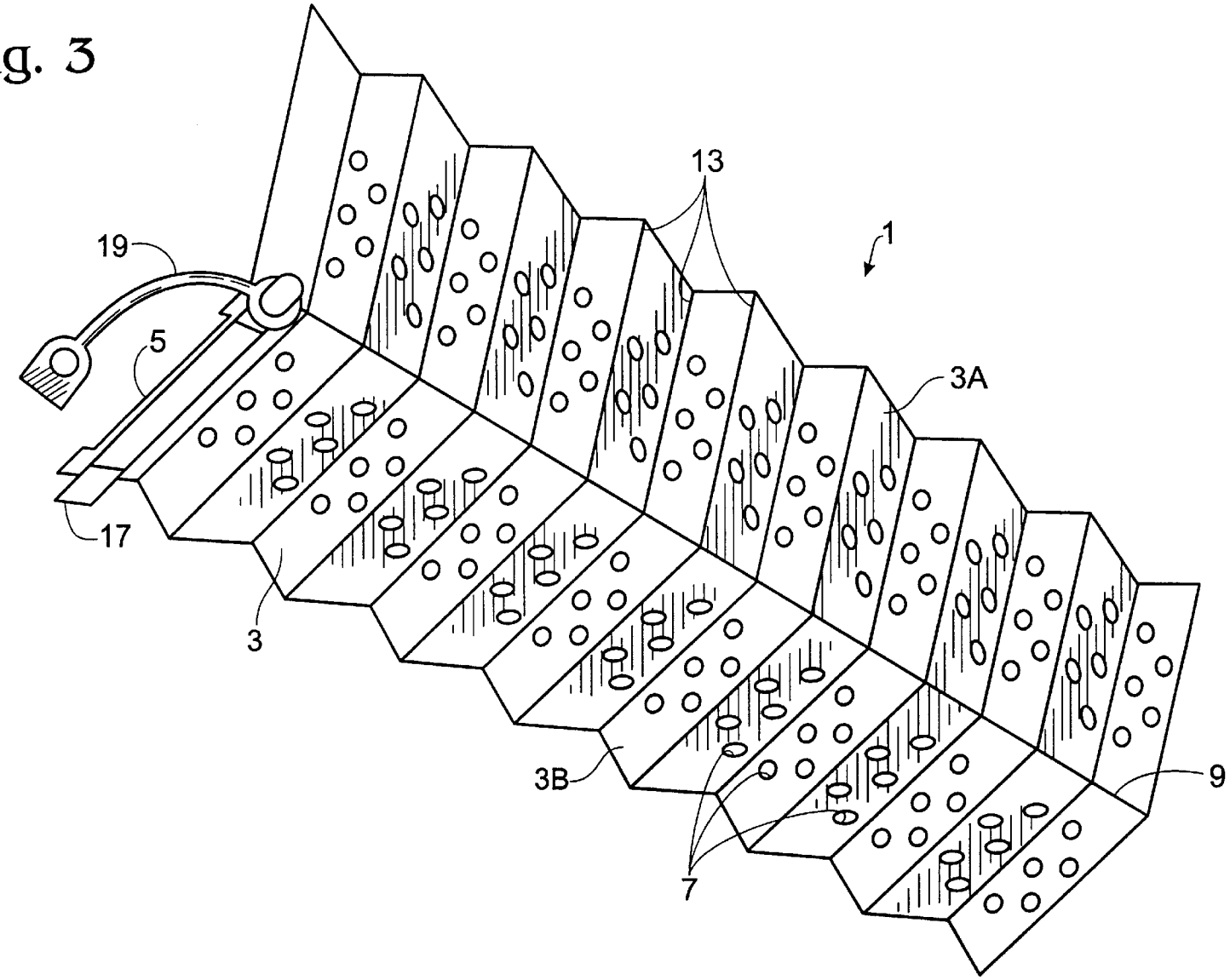
FIG. 3 shows a perspective view of the partially folded hair curler.

The hair curler indicated by the general annotation 1 is made with a sheet 3, preferably formed with a semi-rigid material such as polyethylene or an acrylate resin, but paper or board could also be envisaged.

Materials are preferably selected which hold basically their flat shape, but which form a permanent fold when they are subjected to a pressure combined with a thermal action in a folded condition.

This sheet is provided with a notch 5 and a plurality of perforations or cuttings 7 schematically shown as a plurality of holes being superposed when the hair curler is folded along the central fold 9.

The perforations may also be microperforations as further indicated or one or more large cuttings of the sheet between two zigzag folds.

The sheet comprises lengthwise a permanent fold 9 which results in the sheet part 1A and the part 3B having a tendancy to be overlapped.

Advantageously, on one of the sheet sides, that means on the drawing on the part 3B opposed to the fold 9, an overthickness is provided as indicated by the annotation 11.

The part 3A is folded back onto the part 3B and the fold 9 is fixed thermally.

Moreover, in that position, i.e. with a double thickness of the sheet 3, a plurality of zigzag folds 13 have been made and fixed by a pressure combined with a thermal treatment in the folded condition. Of course, the fixed folds as indicated allow to unfold further the hair curler for its usage.

It is to be noticed that the folds may have rounded shapes instead of free edges.

The notch 5 in the upper part of the half part 3A of the sheet is provided to receive a hair lock by applying the sheet being unfolded to the base of the hair, receiving that hair in said notch 5.

The sheet 3A is then folded onto the sheet 3B while capturing the hair. By folding then the double sheet capturing the hair according to the zigzag folds 13, waves are given to them which will be fixed by any convenient means.

The hair have been also shown schematically as a lock 15 illustrated as being visible under the part 3B.

Of course, this lock is in reality much more substantial than illustrated for clarity's sake on the drawings. The lock width corresponds approximately to the width of the cutting 5.

In principle the sheet length, i.e. also the number of zigzags will be selected according to the length of hair to be treated, whereby the hair cannot go beyond the sheet length.

Appropriate means may be provided so as to hold the hair curler in a folded position of the zigzags. It is to be noticed that the sheet 1, when it is in a flat condition (FIG. 1), is not strictly rectangular. When it is bound, due to its trapezoidal shape, it assumes the shape illustrated in FIG. 2.

A rigid member 17 can be made integral with the portion near the notch 5 of the sheet part 3B by gluing, by insertion into cuttings provided to this end in the sheet or by any means, and a holding member, for example an elastic band 19 or a clip, can hold the hair curler in the folded position thereof according to the fold 9 by capturing the hair between the parts 3A and 3B and shaping them through the zigzag folds 13. The "fixation" may be carried out through any convenient means, for example through a hair drier acting an the preferably wet hair and provided with convenient treating agents, that is hairdressing, fixing, permanent waving agents, etc.

The perforations 7 allow the action of the hair drier and treating products.

It has come especially efficient to provide at the level of the zigzag folds microperforations (non shown) so as to assist the penetration of both fixing element and warm air flow.

The special effect obtained with this technique lies in a succession of ridges or curls and flat parts.

This allows to special effects to be obtained which have not been reached heretofore.

It is to be noticed that it is possible to give a slight folding (illustrated by the annotation 21 in FIG. 2) to the flat part between each zigzag to create complementary effects, that means a free curl followed by a slightly deformed flat part, and then a slight deformation, again a flat part and then an inverted curl shaped with the following zigzag fold, which is of course of an opposed direction with respect to the former one.

Although particular embodiments of the invention have been described, it is to be understood that numerous modifications may be carried out, including in the choice of the material, the dimensions and particularly the zigzag spacings.

Consequently, for example when it is mentioned that the zigzag folds are perpendicular to the central told, it is to be understood that, without departing from the scope of the invention, possibly the zigzag folds may not be strictly perpendicular to the central fold, but may be also slightly slanting.

Likewise, the central fold does not need to be strictly in the center of the sheet, but one of the parts (3A for example) might go beyond the other part 3B if desired, this arrangement bringing however no particular advantage.

It is claimed:

1. A hair-shaping device comprising: a sheet provided with perforations which has been folded a first time lengthwise forming a central fold and then folded in zigzag perpendicularly to said central fold.

2. The device according to claim 1, wherein the sheet comprises over at least half a side a cutting corresponding to a width and height of a hair lock to be interposed between two overlapped thicknesses of the sheet, the so-folded sheet with both sheet parts being overlapped being then folded in zigzag arrangement.

3. The device according to claim 1, wherein the folds are made permanent by pressure and a thermal treatment on the material in a folded condition.

4. The device according to claim 1, wherein at least on one of the sheet edges is opposed to the central fold an overthickness is provided.

5. The device according to claim 1, comprising means such as a clip on an elastic band so as to maintain hair and the hair curler in a position obtained after a zigzag folding.

6. The device according to claim 1, wherein a slight folding is provided on the flat part between each zigzag.

7. A hair-shaping device comprising: a sheet of semi-rigid material provided with perforations which has been folded a first time lengthwise forming a central fold and then folded in zigzag perpendicularly to said central fold.

8. The device according to claim 7, wherein the sheet comprises over at least half a side a cutting corresponding to a width and height of a hair lock to be interposed between two overlapped thicknesses of the sheet, the so-folded sheet with both sheet parts being overlapped being then folded in zigzag arrangement.

9. The device according to claim 7, wherein the folds are made permanent by pressure and a thermal treatment on the material in a folded condition.

10. The device according to claim 7, wherein at least on one of the sheet edges opposed to the central fold an overthickness is provided.

11. The device according to claim 7, comprising a clip on an elastic band so as to maintain hair and the hair curler in a position obtained after a zigzag folding.

12. The device according to claim 7, wherein a slight folding is provided on the flat part between each zigzag.

13. A hair-shaping device comprising: a sheet of paper provided with perforations which has been folded a first time lengthwise forming a central fold and then folded in zigzag perpendicularly to said central fold.

14. The device according to claim 13, wherein the sheet comprises over at least half a side a cutting corresponding to a width and height of a hair lock to be interposed between two overlapped thicknesses of the sheet, the so-folded sheet with both sheet parts being overlapped being then folded in zigzag arrangement.

15. The device according to claim 13, wherein the folds are made permanent by pressure and a thermal treatment on the material in a folded condition.

16. The device according to claim 13, wherein at least on one of the sheet edges opposed to the central fold an overthickness is provided.

17. The device according to claim 13, comprising a clip to maintain hair and the hair curler in a position obtained after a zigzag folding.

18. The device according to claim 13, wherein a slight folding is provided on the flat part between each zigzag.

* * * * *